United States Patent [19]

Darracq et al.

[11] Patent Number: 5,019,225

[45] Date of Patent: May 28, 1991

[54] MOLTEN SALT ELECTROWINNING ELECTRODE, METHOD AND CELL

[75] Inventors: Dominique Darracq, Ville-la-Grand, France; Jean-Jacques Duruz, Geneva, Switzerland; Claude Durmelat, Ferney-Voltaire, France

[73] Assignee: Moltech Invent S.A., Luxembourg

[21] Appl. No.: 350,585

[22] PCT Filed: Aug. 19, 1987

[86] PCT No.: PCT/EP87/00472

§ 371 Date: Feb. 15, 1989

§ 102(e) Date: Feb. 15, 1989

[87] PCT Pub. No.: WO88/01313

PCT Pub. Date: Feb. 25, 1988

[30] Foreign Application Priority Data

Aug. 21, 1986 [CH] Switzerland ..... 86810373.0

[51] Int. Cl.[5] ..... C25C 3/06; C25C 3/08

[52] U.S. Cl. ..... 204/67; 304/64 R; 304/243 R; 304/290 R; 304/291; 204/292; 204/293

[58] Field of Search ..... 204/67, 64 R, 243 R, 204/290 R, 211-293

[56] References Cited

U.S. PATENT DOCUMENTS

| | | | |
|---|---|---|---|
| 3,930,967 | 1/1976 | Alder | 204/67 |
| 4,111,765 | 9/1978 | DeNora et al. | 204/67 |
| 4,309,467 | 1/1982 | Kovach et al. | 428/36 |
| 4,529,494 | 7/1985 | Joo' et al. | 204/290 R |

FOREIGN PATENT DOCUMENTS

| | | |
|---|---|---|
| 0094353 | 11/1983 | European Pat. Off. . |
| 0114085 | 7/1984 | European Pat. Off. . |
| 0115689 | 8/1984 | European Pat. Off. . |
| 0116809 | 8/1984 | European Pat. Off. . |

*Primary Examiner*—John F. Niebling
*Assistant Examiner*—Kathryn Gorgos
*Attorney, Agent, or Firm*—John J. Freer

[57] ABSTRACT

A bipolar electrode for electrowinning aluminum or other metals by electrolysis of a molten salt electrolyte containing a dissolved compound of the metal to be won comprises an anodic and a cathodic surface which are both preserved during operation by dissolution of small amounts of a substance in the electrolyte which is capable of being deposited on either surface at a rate compensating the corrosion thereof during electrolysis. The anodic surface is for example cerium oxyfluoride and the cathodic surface cerium hexaboride, both surfaces being preserved by addition of cerium compounds, such as oxides, fluorides, hydrides etc. to the melt. The cathodic surface may also include titanium diboride on top of or together with cerium hexaboride.

22 Claims, 1 Drawing Sheet

MOLTEN SALT ELECTROWINNING ELECTRODE, METHOD AND CELL

FIELD OF INVENTION

The present invention relates to an electrode for electrowinning a metal by electrolysis of a compound of the metal dissolved in a molten salt electrolyte, the electrode having a body at least a section of which is cathodically polarized. The invention further relates to a cell for molten salt electrowinning comprising at least one electrode according to this invention, and finally the invention relates to a method of electrowinning a metal by molten salt electrolysis using at least one electrode according to the present invention.

BACKGROUND ART

In the art of electrowinning aluminum by electrolysis of alumina dissolved in molten cryolite, considerable efforts have been made to provide dimensionally stable materials for cell components which are in contact with the liquid contents of the cell. Such components include the electrodes as well as lining materials and elements which are immersed in the liquid aluminum to restrict hath movements.

Among the materials proposed for use under the severe corrosion conditions in a molten salt electrolysis cell are primarily the refractory oxides; the Refractory Hard Metal (RHM) borides and cermets containing either of them together with an intimately mixed metallic phase for applications where high electrical conductivity is essential.

Refractory ceramic and cermet materials are known from numerous publications. These materials are used in a wide variety of applications, and their specific composition, structure and other physical and chemical properties may be adapted to the specific intended use.

Materials which were proposed for their use as anodes in molten salt aluminum electrowinning cells are mainly based on oxides of e.g. iron, cobalt, nickel, tin and other metals, which oxides may be provided with enhanced electronic conductivity by doping, non-stoichiometry and so forth. Cathodic materials are mainly based on titanium diboride and similar RHM boride compounds. For example, EP-A-0 115 689 discloses reaction sintered oxide-boride ceramic bodies and EP-A-0 116 809 discloses a porous oxide-boride cermet which is infiltrated with molten aluminum. Oxide-boride ceramics have however not proven to be commercially acceptable as cathode materials in molten salt electrolysis.

FR-A-2 375 349 has described bipolar electrodes with an anode made of a boride/silicide/carbon composite and a cathodic section of various borides including titanium diboride and yttrium boride.

A completely new concept for a dimensionally stable inert anode for an aluminum cell and its manufacture was described in EP-A-0 114 085 wherein such anodes are produced by depositing in-situ a fluorine-containing oxycompound of cerium (referred to as "cerium oxyfluoride") on an anode substrate during electrolysis, with a cerium compound dissolved in the melt and maintained at a suitable concentration. This anode coating is maintained dimensionally stable as long as a sufficient concentration of the cerium-containing compounds is maintained in the melt.

In EP-A-0 094 353 it has also been proposed to use materials in a molten salt aluminum electrowinning cell which are composed of a refractory ceramic coated with $TiB_2$ and wherein the $TiB_2$ coating is maintained by addition of titanium and boron to the liquid aluminum.

A co-pending patent application Ser. No. 322,850, which was simultaneously filed with the present application discloses a new substrate material for the above described cerium oxyfluoride anode coating, this new substrate material being a cermet having a ceramic phase basically comprising a mixture of cerium oxide(s) and alumina and a metallic phase comprising an alloy of cerium and aluminum.

OBJECTS OF THE INVENTION

It is one of the objects of the present invention to provide a new electrode for aluminum electrowinning by electrolysis of a molten salt electrolyte comprising alumina, which electrode has a cathodic section which may be kept dimensionally stable during operation.

It is another object of the present invention to provide an electrode with a cathodic section having a surface in contact with liquid contents of the electrowinning cell which may be preserved by maintaining in the liquid contacting this surface a suitable concentration of species comprising constituents of the surface material of the cathodic section.

It is a further object of the present invention to provide a cathodic material, constituents of which are present in the bath and are identical to constituents of a surface material of a dimensionally stable, inert anode, whereby the anodic surface material is simultaneously preserved.

It is a still further object of the present invention to provide a bipolar electrode for the above mentioned purpose which comprises an anodic and a cathodic section, both sections having surface materials which may be preserved by maintaining a concentration of a species in the liquid contents of the cell which species may preserve the anodic and the cathodic surfaces.

BRIEF DESCRIPTION OF THE DRAWINGS

The invention is further described with reference to the drawings, in which.

SUMMARY OF INVENTION

Figure 2:
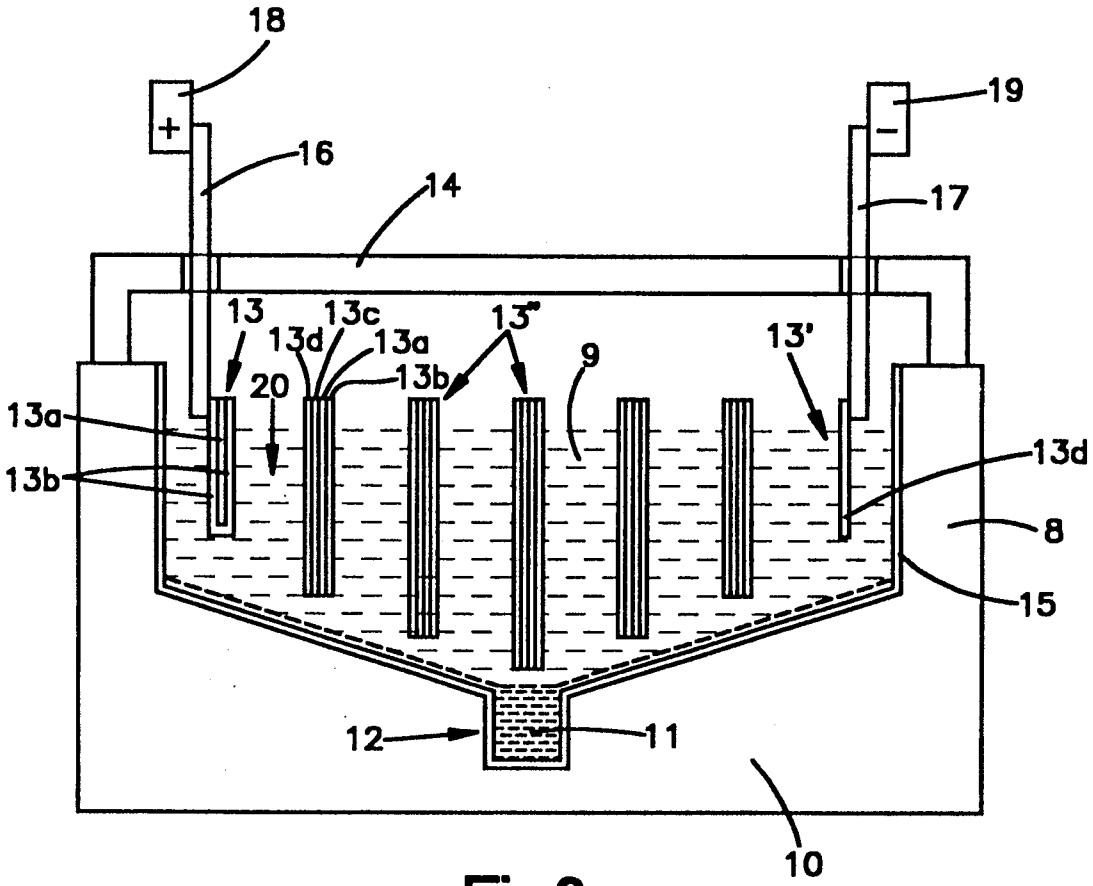
FIG. 2 is a schematic view of an aluminum electrowinning cell employing a plurality of bipolar electrodes according to the present invention.

The above and other objects are achieved by a method of producing a metal by electrolysis of a compound of said metal dissolved in a molten salt electrolyte, wherein an anodic surface is preserved by maintaining in the electrolyte ions of a metal $M_1$ selected from the rare earth metals, the alkaline earth metals and the alkali metals, characterized by using a cathode comprising: a cathodic substrate comprising boride(s) of at least one metal $M_1$ or boride(s) of at least one metal $M_1$ together with boride(s) of at least one metal $M_2$ selected from Group IVA (Ti,Zr,Hf), Group VA (V,Nb,Ta) or Group VIA (Cr,Mo,W), Mg, Si, Al, La, Y, Mn, Fe, Co, and Ni; and a cathodic surface made of boride(s) of at least one metal $M_1$ or $M_2$, the concentration of $M_1$ ions in the electrolyte serving also to preserve the cathodic surface.

The mentioned objects are further achieved by a method of producing a metal by electrolysis of a compound of the metal dissolved in a molten salt electrolyte using at least one electrode as described herein.

Other objects of the present invention are achieved by providing a molten salt electrowinning cell employing at least one electrode as described herein, which electrode may be a bipolar electrode, a plurality of which may be arranged within said cell in side-by-side relationship.

In an electrode as described above, cerium is specially preferred among the metals Ml, followed by lanthanum, calcium and yttrium.

The terms "cathodic substrate" as used herein includes the special case where both the cathodic substrate and the cathodic surface are made of the same boride(s) of the same metal(s) $M_1$, i.e. a bulk material.

Thus, the cathodic section of an electrode according to the present invention may, in the case where the entire cathodic section consists of the same material, be made entirely of a bulk material such as a cerium boride or, in the case where it comprises a cathodic substrate and a cathodic coating, these two parts may be made of different materials. The cathodic substrate always contains cerium boride or another rare earth metal boride, alkaline earth metal boride or alkali metal boride and need only comply with two physical requirements i.e. electrical conductivity and thermodynamic stability with the cathodic coating and, in the case of a bipolar arrangement, also with the anodic section.

In the case of metal $M_1$ being cerium, the cathodic substrate necessarily comprises a cerium boride which may be mixed with another boride such as titanium diboride, and the cathodic surface may be a cerium boride, cerium hexaboride being the preferred one, and/or another boride such as titanium diboride or other RHM boride compounds.

The cathodic surface material, i.e. the cathodic substrate or the cathodic coating may also comprises microdispersed aluminum.

In a preferred embodiment of the present invention, the electrode is a bipolar electrode. In this case, the electrode body has a second, anodically polarized section comprising an anodic substrate and an anodic surface.

This anodic surface may be a surface coating or a surface part of a bulk anode section and may be made of or may comprise an oxycompound of cerium, cerium oxyfluoride being preferred.

The anodic and cathodic sections of a bipolar electrode according to the present invention may be separated one from the other by an intermediate stable layer of an alloy or a compound of cerium and another metal such as copper, silver, or a noble metal.

In the case where the anodic surface is a coating on an anodic substrate, this anodic substrate may be a cermet having a ceramic phase made of a mixture of cerium oxide(s) and alumina, or mixed oxides, and sulphides, nitrides, or phosphides of at least one of cerium and aluminum, and a metallic phase composed of an alloy of cerium and aluminum and optionally silver, and/or at least one noble metal.

In bipolar electrodes according to the present invention, the anodic surface, be it an anodic coating or a surface part of a bulk anodic section, may be produced in-situ, i.e. prior to or during the electrowinning process in the cell by deposition of cerium oxyfluoride onto the anodic section, or ex-situ, by sintering, hot-pressing, spraying or painting and curing of cerium oxyfluoride or a precursor thereof in bulk or onto the anodic substrate. The cathodic coating is produced ex-situ by sintering, hot-pressing, spraying or painting and curing of cerium hexaboride or in the case of titanium diboride or another RHM boride compound by sintering of a powder of $TiB_2$ or another RHM boride or by reaction sintering a precursor thereof onto the cathodic substrate.

An electrode as described above may be used as already mentioned for electrowinning aluminum by electrolysis of alumina dissolved in molten cryolite. However, its use in other metal winning processes using a liquid metal cathode is also contemplated.

According to another main aspect of the present invention, the cathodic and/or the anodic surface of the present electrode may be preserved and protected from corrosion by the agressive contents in a molten salt electrowinning cell by adding a substance to the melt which inhibits the dissolution of surface-constituting materials on the anodic as well as on the cathodic surface and by maintaining a suitable concentration of species produced by dissociation of said substance in the electrolyte.

In the case where the anodic surface comprises cerium oxyfluoride and the cathodic surface comprises cerium hexaboride, cerium or cerium compounds may be added to the melt, and a suitable concentration of cerium-containing ions maintained. More generally, the same rare earth metal(s), alkaline earth metal(s) or alkali metal(s) included in the cathodic and anodic surfaces, or at least in one of them, are added to the melt.

In the method of electrowinning aluminum according to the present invention which includes using at least one electrode as described above, the substance added to the electrolyte in order to maintain a suitable concentration of cerium-containing ions may be selected from oxides, halides, oxyhalides and hydrides of cerium.

The concentration of cerium-containing ions in the electrolyte may be chosen well below the solubility limits of the above cerium compounds, as the maintenance process of the anodic and cathodic surfaces is not a simple dissolution-deposition mechanism of cerium-containing ions.

DETAILED DESCRIPTION OF THE INVENTION

An electrode according to the present invention may be employed in a molten salt electrowinning cell in a variety of different cell configurations. Thus, the electrode may be a cathode in a cell of the drained cathode type, e.g. a bulk body of cerium hexaboride maintained dimensionally stable by maintaining cerium ions in the electrolyte. This causes a small concentration of metallic cerium in the electrowon metal such as aluminum in contact with the cathodic surface, which preserves the cathodic cerium hexaboride surface. This cathode may be used in conjunction with a conventional carbon anode or, preferably, with an inert anode having an anode substrate coated with a cerium oxyfluoride coating which is simultaneously maintained dimensionally stable by the cerium ions in the electrolyte.

The cathode used in the above cell may also comprise a structure where the cerium (or other metal $M_1$) is confined to the cathodic substrate, and the cathodic surface is constituted by a coating of e.g. titanium diboride or another RHM boride compound.

Another embodiment of an electrode according to the present invention is employed in a bipolar configuration. Each bipolar electrode has an anodic part including a cerium oxyfluoride coating on an appropriate anodic substrate and a cathodic part which may for example be entirely formed of cerium hexaboride or may have a substrate of cerium hexaboride coated with titanium diboride or another RHM boride compound, or may be cerium boride coated on another substrate.

The invention is described in the following in detail with reference to one of the above embodiments only, namely the bipolar configuration with an anodic surface constituted by cerium oxyfluoride and a cathodic surface of cerium hexaboride. The following detailed description relates to the manufacture of a bipolar electrode in which the cathodic and anodic sections are considered separately. The operation and maintenance of this electrode is discussed later.

CATHODIC ELECTRODE SECTION

In the following part of the description, the electrode comprises a bulk cathodic section i.e. the entire cathodic section including the cathodic surface consists of the same material throughout. This cathodic section consists of a dense structure of cerium hexaboride produced by sintering cerium hexaboride powder into a sheet of rectangular cross section. The production of this sheet may conveniently be carried out by sintering and the resulting sintered sheet attached to the aforementioned intermediate stable layer prior to or during assembly with the anodic section. This intermediate layer may comprise at least one metal such as copper, silver and the noble metals and optionally, an alloy of cerium; this metal being chosen such that its oxide is less stable than cerium oxide. It may further comprise a cerium alloy (e.g. cerium-aluminum) or a cerium compound. As the oxides of these metals are less stable than cerium oxide, no reduction of cerium oxide will occur when an anodic cerium oxide layer comes into contact with the intermediate layer, as described subsequently under the preparation of the anodic section. Further, the intermediate layer must be electrically conductive and thermodynamically stable in contact with the anodic section and the cathodic section i.e. cerium hexaboride.

Alternatively, the bulk cathodic section may be a mixture of cerium hexaboride and a boride of at least one other metal selected from Group IVb (Ti,Zr,Hf), Group Vb (V,Nb,Ta) or VIb (Cr,Mo,W), Mg, Si, Al, La, Y, Mn, Fe, Co, and Ni. Further, the cerium hexaboride or the mixture of cerium hexaboride and the boride of these other metals may comprise microdispersed aluminum which improves the electrical conductivity and mechanical properties of the cathodic section.

In the case where the anodic substrate is chemically stable in contact with the cerium hexaboride of the cathodic section, no stable intermediate layer is required.

In alternative embodiments, the described cathodic section may comprise at or adjacent its surface additions of $TiB_2$ or a $TiB_2$/Al cermet, or it may be coated with these materials.

Where the electrode according to the present invention is a cathode only, it may be produced in a shape which can be fitted in a known aluminum electrowinning cell with drained cathode configuration replacing the classical carbon cathode, e.g. in the form of a layer to be arranged on the cell bottom. However, the preferred embodiment of this invention is a bipolar electrode of sheet-like shape with the cathodic section on one side and the anodic section on the other.

If the cathodic section is not produced on a stable intermediate layer, it may be combined with such a layer by any suitable process such as cladding, sintering or the like. In a subsequent process step or simultaneously therewith the anodic substrate may be applied to the back surface of the stable intermediate layer by any suitable process including sintering, plasma spraying, bonding or the like.

ANODIC ELECTRODE SECTION

The anodic substrate may be any electronically conductive material which is sufficiently resistant to corrosion by the electrolyte of an aluminum electrowinning cell to withstand exposure to the electrolyte during its subsequent coating process in-situ without unduly contaminating the bath, as described in the following section of the description. Alternatively, if the anodic coating is applied to the anodic substrate ex-situ, e.g. by sintering, this requirement is less stringent, as the electrode will only come into contact with the electrolyte once the protective anode coating has been applied.

Materials which come into consideration for this purpose are doped oxides, such as tin dioxide, zinc oxide cerium oxides, copper oxides or others, and cermets. Specially preferred is a cermet having at least one of copper, silver and the noble metals optionally associated with a cerium-aluminum alloy as metallic phase and at least one of the following: doped tin dioxide, doped zinc oxide, doped cerium oxides or oxyfluorides, or a mixture of ceria-alumina or a cerium/aluminum mixed oxide optionally associated with other compounds of cerium or aluminum such as, nitrides or phosphides as ceramic phase. Besides the suitable physical and chemical properties of this cermet, it does not contain any substantial amounts of other substances which may contaminate the liquid contents of an aluminum electrowinning cell upon initial or occasional corrosion during the operation of the electrode.

The preferred cermet material may be produced by sintering powders of cerium and aluminum together with their oxides, or by sintering powders of these oxides in reducing atmosphere or by sintering the metal powders under oxidizing atmosphere. The preferred method is reactive sintering of aluminum metal with oxides of cerium. A detailed description of the production process of this cermet is included in Example 2 below.

In the case where ceria is present in the anodic substrate material, an intermediate layer must be chosen which is thermodynamically stable therewith, as discussed above.

The final production of the anodic coating may include ex-situ formation thereof by sintering, plasma-spraying, hot-pressing, painting and curing or any other suitable known method. One preferred process, however, is the in-situ formation of the anodic coating during operation of the electrode in an aluminum electrowinning cell.

IN-SITU PRODUCTION OF ANODE COATING AND PRESERVATION OF ANODIC AND CATHODIC COATINGS

The electrode as prepared according to the above process steps may now be introduced into a molten salt aluminum electrowinning cell comprising a molten cryolite electrolyte containing up to 10 weight % alumina dissolved therein. Additionally, this electrolyte contains an addition of a cerium compound in a concentration of, for example, about 1–2 weight %.

Generally, when cerium is dissolved in a fluoride melt the protective anode coating is predominantly a fluorine-containing oxycompound of cerium, referred to as "cerium oxyfluoride". When dissolved in molten cryolite, cerium remains dissolved in a lower oxidation state but, in the vicinity of an oxygen-evolving anode, oxidizes in a potential range below or at the potential of oxygen evolution and precipitates as a fluorine-containing oxycompound which remains stable on the anode surface. The thickness of the fluorine-containing cerium oxycompound coating can be controlled as a function of the amount of the cerium compound introduced in the electrolyte, so as to provide an impervious and protective coating which is electronically conductive and functions as the operative anode surface, i.e. in the present case an oxygen evolving surface. Furthermore, the coating is self-healing or self-regenerating, and it is permanently maintained by keeping a suitable concentration of cerium in the electrolyte.

The term fluorine-containing oxycompound is intended to include oxyfluoride compounds and mixtures and solid solutions of oxides and fluorides in which fluorine is uniformly dispersed in an oxide matrix. Oxycompounds containing about 5–15 atom % of fluorine have shown adequate characteristics including electronic conductivity; however, these values should not be taken as limiting. For cerium as metal $M_1$, the oxycompound can have a composition of the formula $CeO_xF_y$ where $x=0.01$ to 0.5 and preferably $x=1.85$ to 1.95 and $y=0.05$ to 0.15.

It is understood that the metal being electrowon will necessarily have to be more noble than the cerium ($Ce^{3+}$) dissolved in the melt, so that the electrowon metal preferably deposits at the cathode with only a small cathodic deposition of cerium, sufficient to maintain a desired concentration of cerium metal in the molten electrowon metal in order to inhibit the dissolution of the cerium hexaboride of the cathodic surface.

Such metals to be electrowon can be chosen from group Ia (lithium, sodium, potassium, rubidium, cesium), group IIa (beryllium, magnesium, calcium, strontium, barium), group IIIa (aluminum, gallium, indium, thallium), group IVb (titanium, zirconium, hafnium), group Vb (vanadium, niobium, tantalum) and group VIIb (manganese, rhenium).

Also, the concentration of the cerium ions dissolved in the lower valency state in the electrolyte will usually be well below the solubility limit in the melt. For example, when up to 2% by weight of cerium is included in a molten cryolite-alumina electrolyte, the cathodically won aluminum will contain only 1–3% by weight of cerium. This can form an alloying element for the aluminum or, if desired, can be removed by a suitable process.

The anodic coating as produced above provides an effective barrier shielding the anodic substrate from the corrosive action of molten cryolite.

Various cerium compounds can be dissolved in the melt in suitable quantities, the most usual ones being halides (preferably fluorides), oxides, oxyhalides and hydrides. However, other compounds can be employed. These compounds can be introduced in any suitable way to the melt before and/or during electrolysis.

It is to be understood that the cathodic and anodic surfaces such as produced above will be preserved by the maintenance of a suitable concentration of cerium ions in the electrolyte. This concentration, of course, depends on the exact bath chemistry and has to be chosen such that an equilibrium is established at both anodic and cathodic surfaces between the rate at which the cerium compounds at the surfaces are corroded by the liquid cell contents and the rate of re-deposition of cerium-containing species onto the respective surface.

The anodic deposition, be it initial deposition on a blank substrate or continuous deposition once the coating has been formed and is to be preserved, follows the same deposition process as described above. The cathodic surface of the bipolar electrode however only requires to be preserved since it has been produced ex-situ.

EXAMPLES

The above described process of producing the present electrode is now described by way of examples in which anodic and cathodic parts of the electrode are produced in subsequent steps.

EXAMPLE 1

On a sheet substrate of a Ce/Al/Ag alloy of 100 mm × 100 mm square surface and 5 mm thick, 200 g of cerium hexaboride powder (ALFA 99% pure, 325 mesh) is consolidated by cold pressing at a pressure of 32 megapascals. Subsequently, the substrate together with the pressed powder are hot pressed at a temperature of 1150° C. under a continuing pressure of 20 megapascals for one hour.

The resulting composite body is a laminate of the original sheet substrate and a dense sintered layer of cerium hexaboride.

EXAMPLE 2

On the uncoated back surface of the laminated sheet as produced in Example 1, 32 g of a mixed $CeO_2$/Al powder containing 82.7 weight % $CeO_2$ of a grain size between 25 and 35 micrometers (FLUKA AG, of purity higher than 99%) and 17.3 weight % of aluminum CERAC, of 99.5% purity, 325 mesh) is cold pressed at 32 megapascals to a flat, sheet-like composite body. The density of the pressed $CeO_2$/Al powder is 57% of the theoretical density. Subsequently, the composite body is hot pressed under 20 megapascals at 1150° C. for one hour and at 1250° C. for another hour.

The cermet part of the consolidated final composite body has a density of 75% of theoretical density.

While the substrate has a completely dense structure, the cermet part has a porous central region (the pores have dimensions from 20–50 micrometers) surrounded by a denser region containing only closed macropores. Both of these regions have similar microstructure, i.e. a finely dispersed quasi continuous network of cerium aluminate impregnated with a metallic $Al_2Ce$ matrix. The ceramic phase consists of a very finely interconnected grain structure of vermicular or leaf-like grains having a length dimension of 5–10 micrometers and a cross dimension of 1–2 micrometers.

EXAMPLE 3

A laminated sheet as produced in Example 2, comprising an intermediate stable layer of a Ce/Al/Ag alloy with a cerium hexaboride layer on one side and a cerium/aluminum-ceria/alumina cermet on the other side, as well as two terminal electrode sections, one being cathodic and the other anodic, are introduced into a laboratory electrolysis cell comprising a graphite cylinder closed at the bottom by a graphite disc and filled with a powder of cryolite containing 10 weight % alumina and 1.2 weight % of $CeF_3$.

The laminated sheet is arranged in spaced parallel relationship with the terminal electrodes, the flat surfaces facing each other across suitable interelectrode gaps. The cathodic terminal electrode comprises a cerium hexaboride surface facing the anodic substrate of the laminated sheet. The cathodic surface of the laminated sheet faces the anodic terminal electrode comprising an exposed anodic substrate. The anodic terminal electrode is electrically connected with the positive pole and the cathodic terminal with the negative pole of a current source.

The assembly is heated to 970° C. and upon melting of the cryolite powder the current source is activated to pass current through the electrodes and the interelectrode gaps.

During passage of current, cerium oxyfluoride deposits on the anodic substrates of the bipolar electrodes and the anodic terminal electrode.

After initial deposition of the cerium oxyfluoride on the anodic surfaces, an equilibrium state is reached and a stable cerium oxyfluoride layer is obtained. However, as small amounts of cerium metal are cathodically deposited and withdrawn from the cell together with the electrowon aluminum, cerium compounds should be added from time to time to compensate for these cerium losses.

EXAMPLE 4

An amount of 200 g of cerium hexaboride powder (ALFA 99% pure, 325 mesh) were consolidated by cold pressing at a pressure of 32 megapascals into a sheet measuring approximately 100×100×5 mm. The consolidated sheet was then hot pressed at 1600° C. for 30 minutes under a pressure of 20 megapascals. A plate of doped cerium oxyfluoride having approximately the same dimensions was produced by cold pressing 200 g of a 325 mesh powder mixture, of 93.9% $CeO_2$, 3.1% $CeF_3$, 1.0% $Nb_2O_5$ and 2% Cu at a pressure of 32 megapascals followed by sintering at 1550° C. for 1 hour under Argon.

The sheets of cerium hexaboride and doped cerium oxyfluoride were then sandwiched together with an interposed 100×100×0.5 mm sheet of copper foil, and clad or bonded together as an assembly by heating at 1100° C. under Argon for a suitable time, e.g. about 3 minutes.

The resulting assembly is suitable for use as a bipolar electrode in a laboratory-scale aluminum production electrolysis cell as described in Example 3.

EXAMPLE 5

The procedure of Example 4 was followed, except that the copper foil was replaced by a 325 mesh powder mixture of 50 g Cu (metal) and 30 g $Ce_2O_3$, which formed a layer about 2 mm thick in the sandwich. In this case, it is convenient to extend the hot pressing time e.g. to 5 minutes.

As before, the resulting assembly can be used as a bipolar electrode, e.g. in the laboratory scale cell described in Example 3.

Figure 1:
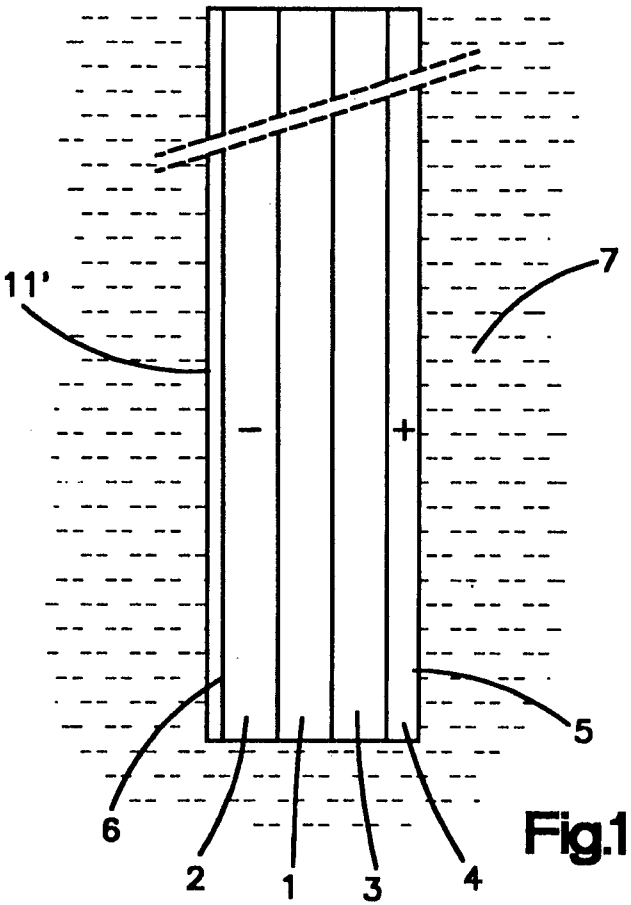
FIG. 1 is a schematic illustration of the laminated configuration of a bipolar electrode according to the present invention.

With reference to FIG. 1, reference number 1 designates the intermediate, stable layer comprised of a Ce/M alloy or intermetallic compound, where M is at least one of copper, silver and the noble metals gold, platinum, iridium, osmium, palladium, rhodium and ruthenium. The layer 1 is coated on one side with a layer 2 constituting the cerium hexaboride cathodic section of the bipolar electrode, and with a layer 3 on its other side, comprised of the cerium/aluminum-ceria/alumina cermet, constituting the anodic substrate of the electrode. This anodic substrate 3 has a top coating 4 or in-situ generated cerium oxyfluoride in contact with the molten electrolyte 7.

Oxygen evolution takes place at the anodic surface 5 and reduction of aluminum ions to aluminum metal occurs at the cathodic surface 6. The anodic surface 5 is preserved by and protected against excessive corrosion from the electrolyte by maintaining a concentration of cerium-containing ions in the electrolyte 7, which ions deposit on the anodic surface 5 at the same rate as they are dissolved in the electrolyte thereby maintaining the anodic surface dimensionally stable. The cathodic surface is preserved by metallic cerium species present in a surface film 11' of molten aluminum which adheres to the cathodic surface.

It is understood that in practice the edge portion of the intermediate layer 1 exposed to the electrolyte 7 will be protected by a protective layer which could, e.g. be a base layer of cerium oxyfluoride also protecting the edge of the anodic substrate 3. The edge of cathodic layer 2 will be covered and protected by the surface film 11'.

FIG. 2 is a schematic representation of an aluminum electrowinning cell having a container 8 for the liquid cell contents 9, and a symmetrically inclined bottom portion 10 of which serves to collect the electrowon aluminum 11 in a central trough 12. The inner space of the container 8 includes an arrangement of a plurality of bipolar electrodes 13'' such as illustrated in FIG. 1 as well as an anodic terminal electrode 13 and a cathodic terminal electrode 13'. The anodic terminal electrode 13 comprises an anodic substrate **13*a* and an anodic coating 13*b* entirely surrounding the anodic substrate 13*a*. The cathodic terminal electrode 13' comprises a cathodic body 13*d*. Each bipolar electrode comprises an anodic coating 13*b*, an anodic substrate 13*a*, a stable intermediate layer 13*c* and a cathodic section 13*d*. The container 8 is closed at the top by a cover 14. An anodic current feeder 16 extending downwards from an anodic terminal 18 through the cover 14 is connected to the anodic terminal electrode 13 and a cathodic current feeder 17 extending downwards from a cathodic terminal 19 through the cover 14 is connected to the cathodic terminal electrode 13'**.

Auxiliary equipment of the cell such as electrode supports, alumina feeders and the like are not shown.

The cell container 8 has an internal lining 15 which may be comprised of cerium hexaboride or any other material which is resistant against corrosion by the liquid cell contents 9. Thus, the cell container 8 may be made of an alumina body or packed alumina which is coated on its internal surfaces with borides such as $TiB_2$, $CeB_6$ or $CeB_4$.

The bipolar electrodes 13'' are all oriented such that their anodic surfaces are facing the side of the cell where the cathodic current feeder 16 enters the cell and their cathodic surfaces face the other side. Electrolysis is carried out by passing current from the anodic terminal electrode 13 across the bipolar electrodes 13'' and the interelectrode gaps 20 to the cathodic terminal electrode 13' from where it leaves the cell via the cathodic current feeder 17.

MODIFICATIONS

The present invention is described in the foregoing by way of example and should not be construed as being limited thereto.

Thus, it is the basic principle of this invention to provide an electrode, be it a bipolar electrode or a monopolar cathodic electrode to he used together with an independent anode, wherein at least one of the electrode surfaces and preferably, both anodic and cathodic surfaces are preserved during operation by dissolving a substance in the electrolyte which is a constituent of the cathodic as well as of the anodic surface; this substance being dissolved in the electrolyte and in the electrowon metal.

This principle is applicable to a variety of molten salt electrowinning processes for metals which are more noble than the metal contained in the compound which is dissolved in the electrolyte to preserve the anodic and cathodic surfaces, e.g. cerium ($Ce^{3+}$). Such metals to be electrowon can be chosen from group Ia (lithium, sodium, potassium, rubidium, cesium), group IIa (beryllium, magnesium, calcium, strontium, barium), group IIIa (aluminum, gallium, indium, thallium), group IVb (titanium, zirconium, hafnium), group Vb (vanadium, niobium, tantalum) and group Vllb (manganese, rhenium).

Also, the electrode materials described above by way of example may include other materials in substantial quantities to form mixtures with the main components or in small amounts as dopants, in order to improve their density or electrical conductivity. Additions of tantalum, niobium, yttrium, lanthanum, praseodymium and other rare-earth-element-containing species in small quantities have been reported to increase the density of the cerium oxyfluoride anodic coating, thereby rendering it more impervious, tantalum and niobium or their oxides also improving the electrical conductivity. Such additives can likewise be incorporated in the cathodic section as can other additives such as $AlB_2$, $AlB_{12}$, $TiB_2$, $CeB_4$, $CeB_6$, TiN and CeN.

Also the described production process of an electrode according to the present invention is only an example and various modifications may be carried out without departing from the scope of the appended claims.

We claim:

1. A method of producing a metal by electrolysis of a compound of said metal dissolved in a molten salt electrolyte, wherein an anodic surface is preserved by maintaining in the electrolyte ions of cerium alone or cerium with another metal $M_1$ selected from other rare earth metals, alkaline earth metals, or alkali metals, characterized by cathodically polarizing a cathode comprising: a cathodic substrate which consists of one or more borides of cerium boride alone or cerium boride together with one or more borides of metals $M_1$ or metals $M_2$, wherein the metals $M_2$ are selected from Ti, Sr, Hf, V, Nb, Ta Cr, Mo, W, Mg,Si, Al, La, Y, Mn, Fe, Co, and Ni; and a cathodic surface which consists of at least one boride from the group consisting of (a) cerium boride alone, (b) cerium boride together with boride of at least one metal from group $M_1$ or $M_2$, and (c) borides of metals $M_2$, with the proviso that one or more of the cathodic substrate and the cathodic surface may further contain additives from the group consisting of microdispersed aluminum, TiN and CeN, whereby the concentration of the cerium ions plus other $M_1$ ions, when present, in the electrolyte serves also to preserve the cathode.

2. The method of claim 1, wherein aluminum is the metal to be electrowon from alumina dissolved in a molten cryolite electrolyte.

3. The method of claim 2, wherein the metal $M_1$ is selected from lanthanum, calcium and yttrium.

4. The method of claim 1, wherein the concentration of cerium ions in the electrolyte is maintained at a suitable level by adding cerium compounds or cerium metal to the electrolyte.

5. The method of claim 4, wherein said compound added to the electrolyte is selected from oxides, halides, oxyhalides and hydrides of cerium.

6. The method of claim 1, wherein the concentration of cerium ions in the electrolyte is well below their solubility limit.

7. The method of claim 1, wherein the cathodic substrate comprises cerium hexaboride and the cathodic surface comprises one or more of cerium hexaboride and titanium diboride.

8. The method of claim 1, wherein the anodic and cathodic surfaces are incorporated in bipolar electrodes.

9. The method of claim 8, wherein the anodic surface comprises an oxycompound of cerium and is separated from the cathodic substrate by an intermediate stable layer.

10. A molten salt electrolysis cell for the electrowinning of aluminum from alumina dissolved in a molten cryolite electrolyte comprising a plurality of bipolar electrodes in side-by-side relationship, each bipolar electrode comprising an anodic surface comprising an oxycompound of cerium, an intermediate stable layer, and a cathodic substrate and cathodic surface as defined in claim 1, there being a concentration of cerium ions in the electrolyte which preserves the anodic and cathodic surfaces.

11. A bipolar electrode in an electrolysis cell for the electrowinning of aluminum from alumina dissolved in a molten cryolite electrolyte, said bipolar electrode in said cell comprising: (a) an anodic surface comprising an oxycompound of cerium; (b) an intermediate layer; (c) a cathodic section made up of the cathodic substrate and the cathodic surface of claim 1; (d) a protective layer comprising cerium oxyfluoride for the anodic surface exposed to said electrolyte; (e) a protective layer comprising cerium oxyfluoride for any portion of said intermediate layer exposed to said electrolyte; and (f) a protective layer comprising metallic cerium species present in molten aluminum for the cathodic surface exposed to said electrolyte; wherein a concentration of cerium ions is present in the electrolyte for preservation of said electrode surfaces.

12. A molten salt electrolysis cell for the electrowinning of aluminum from alumina dissolved in a molten cryolite electrolyte, said cell comprising an anodic terminal electrode on one cell side, a cathodic terminal electrode on an opposite cell side, a plurality of bipolar electrodes in side-by-side facing relationship, but spaced apart from one another and spaced between said anodic and cathodic terminal electrodes, each bipolar electrode comprising an anodic surface comprising an oxycompound of cerium, an intermediate layer, and a cathodic section made up of the cathodic substrate and the cathodic surface of claim 1, with each bipolar electrode anodic surface facing said cathodic terminal electrode and each bipolar electrode cathodic surface facing said anodic terminal electrode, and with there being a concentration of cerium ions in the electrolyte which preserves the anodic and the cathodic surfaces.

13. A molten salt electrolysis cell for the electrowinning of aluminum from alumina dissolved in a molten cryolite electrolyte comprising a plurality of bipolar electrodes in side-by-side facing relationship, but spaced apart from one another, each bipolar electrode comprising an anodic surface comprising an oxycompound of cerium, an intermediate layer, and a cathodic section made up of the cathodic substrate and the cathodic surface of claim 1, and with there being a concentration of a constituent of the cathodic as well as the anodic surface dissolved in the electrolyte and in the electrowon metal which preserves the anodic and cathodic surfaces.

14. An electrode for electrowinning a metal by electrolysis of a compound of the metal dissolved in a molten salt electrolyte according to the method of claim 1, the electrode having a body at least a section of which is cathodically polarized, characterized in that said cathodic section has a cathodic substrate consisting of cerium boride alone, or cerium boride together with one or more borides of metal $M_1$ and metal $M_2$ borides, wherein metal $M_1$ is selected from the rare earth metals other than cerium, the alkaline earth metals and the alkali metals and metal $M_2$ is selected from Ti, Zr,, Hf, V, Nb, Ta, Cr, Mo, W, Mg, Si, Al, La, Y, Mn, Fe, Co, and Ni; and a cathodic surface which consists of at least one boride from the group consisting of (a) cerium boride alone, (b) cerium boride together with boride of at least one metal from group $M_1$ or $M_2$, and (c) borides of metals $M_2$, with the proviso that one or more of the cathodic substrate and the cathodic surface may further contain additives from the group consisting of microdispersed aluminum, TiN and CeN.

15. The electrode of claim 14, wherein the cathodic substrate comprises cerium hexaboride and the cathodic surface comprises one or more of cerium hexaboride and titanium diboride.

16. The electrode of claim 14, wherein the electrode is a bipolar electrode further comprising an anodic section comprising an anodic surface.

17. The electrode of claim 16, wherein the anodic surface comprises an oxycompound of cerium.

18. The electrode of claim 17, wherein the anodic section or said anodic surface is made of doped cerium oxyfluoride.

19. The electrode of claim 18, wherein the anodic substrate is made of a cermet comprising at least one metal of copper, silver, and the noble metals, or said metals with one or more of: (1) a cerium-aluminum alloy as metallic phase and at least one of doped tin dioxide, doped zinc oxide, doped cerium oxides or oxyfluorides, a mixture of ceria and alumina, and a cerium-/aluminum mixed oxide; and (2) other compounds of cerium or aluminum, including nitrides or phosphides as ceramic phase.

20. The electrode of claim 16, wherein the anodic and cathodic sections are separated by an intermediate stable layer.

21. The electrode of claim 20, wherein the intermediate stable layer comprises at least one metal selected from copper, silver and the noble metals.

22. The electrode of claim 21, wherein the intermediate layer further comprises a cerium alloy or a cerium compound.

* * * * *

UNITED STATES PATENT AND TRADEMARK OFFICE

CERTIFICATE OF CORRECTION

PATENT NO. : 5,019,225

DATED : May 28, 1991

INVENTOR(S) : Darracq et al

It is certified that error appears in the above-identified patent and that said Letters Patent is hereby corrected as shown below:

Claim 1, column 11, line 62 of the Patent, delete "Sr" before "Hf" and substitute --Zr-- therefor.

Signed and Sealed this

Third Day of November, 1992

*Attest:*

DOUGLAS B. COMER

*Attesting Officer*

*Acting Commissioner of Patents and Trademarks*